US009857718B2

(12) United States Patent
Yamamoto

(10) Patent No.: US 9,857,718 B2
(45) Date of Patent: Jan. 2, 2018

(54) DESTATICIZING BRUSH AND IMAGE FORMING APPARATUS

(71) Applicant: CANON KABUSHIKI KAISHA, Tokyo (JP)

(72) Inventor: Daisuke Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/956,221

(22) Filed: Dec. 1, 2015

(65) Prior Publication Data

US 2016/0161875 A1 Jun. 9, 2016

(30) Foreign Application Priority Data

Dec. 8, 2014 (JP) ..... 2014-247890

(51) Int. Cl.
*G03G 15/00* (2006.01)
*G03G 15/02* (2006.01)

(52) U.S. Cl.
CPC ..... *G03G 15/0216* (2013.01); *G03G 15/6573* (2013.01); *B65H 2301/5133* (2013.01); *G03G 15/6552* (2013.01)

(58) Field of Classification Search
CPC ..... G03G 21/00; G03G 21/0035; G03G 2215/00658; G03G 15/0216; G03G 15/6573; B65H 2301/5133; B65H 2301/5321; B65H 2515/716; B65H 2404/561; B65H 2301/5132
See application file for complete search history.

(56) References Cited

U.S. PATENT DOCUMENTS 4,761,706 A * 8/1988 Fornsel ..... H02H 3/0935 361/87
4,771,360 A * 9/1988 Ayash ..... H05F 3/02 361/221
6,009,301 A * 12/1999 Maher ..... G03G 21/0035 15/256.5
2005/0276637 A1 12/2005 Koike

FOREIGN PATENT DOCUMENTS

| | | | |
|---|---|---|---|
| JP | H06-045089 | A | 2/1994 |
| JP | H08-095393 | A | 4/1996 |
| JP | H09-148089 | A | 6/1997 |
| JP | H10-154593 | A | 6/1998 |
| JP | 2001-070050 | A | 3/2001 |
| JP | 2002-008890 | A | 1/2002 |
| JP | 2004-290439 | A | 10/2004 |
| JP | 2010-176963 | A | 8/2010 |

* cited by examiner

*Primary Examiner* — Matthew G Marini
(74) *Attorney, Agent, or Firm* — Canon USA, Inc. I.P. Division

(57) ABSTRACT

A destaticizing brush includes a grounding member, a conductive brush member, and an adhesive tape member. The conductive brush member is bent back in a U-turn shape along an outer periphery of the grounding member in a direction in which a longitudinal direction intersects the grounding member such that the conductive brush member is in electric contact with the grounding member. An outer periphery of the conductive brush member that has been bent back and the grounding member are adhered in an integrated manner with the adhesive tape member, and at least one end of the conductive brush member is exposed from the adhesive tape member.

16 Claims, 9 Drawing Sheets

DESTATICIZING BRUSH AND IMAGE FORMING APPARATUS

BACKGROUND OF THE INVENTION

Field of the Invention

The present disclosure relates to a destaticizing brush and an image forming apparatus including the same.

Description of the Related Art

In image forming apparatuses such as a copier, a printer, and a facsimile machine, a destaticizing brush is used to reduce or remove static electricity charged on a sheet.

There is a destaticizing brush in which a brush material formed of an arrangement of a plurality of pieces of electroconductive fiber is pinched with an aluminum tape and one side of an adhesive surface of a conductive two-sided adhesive tape so as to integrally form a unit. The other adhesive surface of the conductive two-sided adhesive tape is adhered to a conductive holding member such as a metal plate such that the destaticizing brush unit is held therewith and is grounded, through a grounding member, by being in electric contact with a grounding portion such as a side plate.

Generally, adhesiveness of a conductive two-sided adhesive tape is weak. Accordingly, the two-sided adhesive tape may come off when a conveyed sheet and the destaticizing brush come in contact with and slide against each other. As a measure of the above, the destaticizing brush unit and the holding member may be nipped with a nip member so that the two-sided adhesive tape does not come off. However, the structure will become complex and a number of components will be used causing the destaticizing brush to become costly. Furthermore, since conductive two-sided adhesive tapes are expensive and prices of copiers, printers, facsimile machines, and the like are required to be reduced, a destaticizing brush having a simple and inexpensive configuration is in need.

For example, in Japanese Patent Laid-Open No. 2002-8890, a destaticizing unit is proposed in which a destaticizing brush main body portion is adhered to a grounding plate with a non-conductive adhesive tape and in which a destaticizing brush that is inserted into an opening provided in the grounding plate comes in electric contact with a wall surface of the opening at a uniform pressure.

However, in the destaticizing unit of Japanese Patent Laid-Open No. 2002-8890, a contact failure may occur due to aged deterioration of the destaticizing brush weakening the pressure pressing the wall surface of the opening of the grounding plate.

SUMMARY OF THE INVENTION

The present disclosure provides a destaticizing brush that overcomes the above problems and that has a simple and inexpensive configuration.

A destaticizing brush includes a grounding member that has a line-like shape and that performs electrical grounding, a conductive brush member configured of a plurality of pieces of wire and that comes in contact with an object, and a tape member that has adhesiveness. In the destaticizing brush, the conductive brush member is bent back in a U-shape around an outer periphery of the grounding member and comes in contact with the grounding member, the tape member adheres the conductive brush member and the grounding member in an integrated manner while the tape member covers an outer periphery of the conductive brush member bent in the U-shape, and at least one end of the conductive brush member is exposed from the tape member and comes in contact with the object.

An image forming apparatus includes an image forming device that forms an image on a sheet, a destaticizing brush that comes in contact with a sheet that is conveyed and that destaticizes the sheet, the destaticizing brush including a grounding member that has a line-like shape and that performs electrical grounding, a conductive brush member configured of a plurality of pieces of wire and that comes in contact with the sheet, and a tape member that has adhesiveness. In the image forming apparatus, the conductive brush member is bent back in a U-shape around an outer periphery of the grounding member and comes in contact with the grounding member, the tape member adheres the conductive brush member and the grounding member in an integrated manner while the tape member covers an outer periphery of the conductive brush member bent in the U-shape, and at least one end of the conductive brush member is exposed from the tape member and comes in contact with the sheet.

Further features of the present invention will become apparent from the following description of exemplary embodiments with reference to the attached drawings.

DESCRIPTION OF THE EMBODIMENTS

Figure 1:
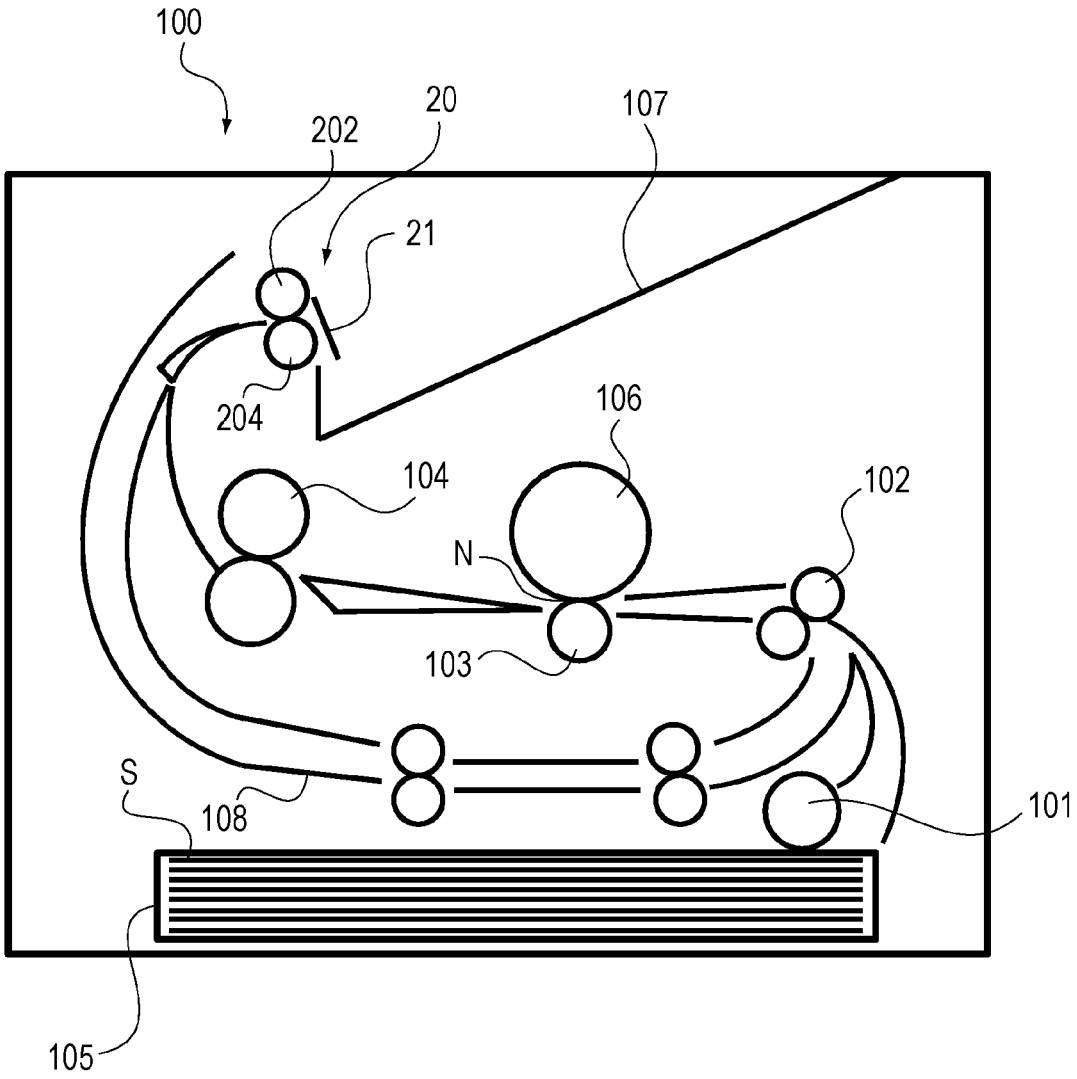
FIG. 1 is a cross-sectional explanatory drawing illustrating a configuration of an image forming apparatus including a destaticizing brush according to a first exemplary embodiment of the present disclosure.

Referring to the drawings, exemplary embodiments of an image forming apparatus including a destaticizing brush according to the present disclosure will be described in detail.

First Exemplary Embodiment

Referring to FIGS. 1 to 6, a configuration of a first exemplary embodiment of an image forming apparatus including a destaticizing brush according to the present disclosure will be described first.

(Image Forming Apparatus)

FIG. 1 is a cross-sectional explanatory drawing illustrating a configuration of an image forming apparatus including a destaticizing brush according to the present disclosure. An image forming apparatus 100 illustrated in FIG. 1 is an example of a laser beam printer. In FIG. 1, the image forming apparatus 100 includes a photosensitive drum 106 serving as an image carrier that is an image forming member that forms an image on a sheet S.

The image forming apparatus 100 further includes a feeding cassette 105, a feed roller 101, a registration roller 102, and the like that configures a sheet feeding portion that separates and feeds the sheets S sheet by sheet to a transfer nip portion N formed between the photosensitive drum 106 and a transfer roller 103 serving as a transfer member. The image forming apparatus 100 further includes a laser scanner unit (not shown) serving as an image exposing member that irradiates a laser beam on a surface of a photosensitive drum 106 according to image information.

The image forming apparatus 100 further includes a fixing device 104 serving as a fixing member. Furthermore, a discharge tray 107 is provided in the upper portion of the image forming apparatus 100. An image forming process member such as the photosensitive drum 106 serving as the image forming device is configured as a process cartridge that is detachable with respect to a main body of the image forming apparatus 100.

The image forming process member that is provided in the process cartridge in an integrated manner includes the photosensitive drum 106 serving as an image carrier that carries an electrostatic latent image, and a charge roller serving as a charge member (not shown) that uniformly charges the surface of the photosensitive drum 106. Furthermore, a developing device serving as a development member (not shown) that supplies developer (toner) to the electrostatic latent image formed according to image information by irradiation of the laser beam, from a laser scanner unit (not shown), on the surface of the photosensitive drum 106 that has been uniformly charged is provided.

A toner image formed on the surface of the photosensitive drum 106 upon supply of toner from the developing device (not shown) is transferred onto a sheet S. A cleaning device and the like serving as a cleaning member (not shown) that scrapes off the toner remaining on the surface of the photosensitive drum 106 after the above to perform cleaning is provided.

Image information is sent to a control unit of the image forming apparatus 100 from a personal computer or the like. The control unit that has performed image forming processing on the image information sends out a print signal. Then, the sheets S that are stacked on an intermediate plate that can be lifted up and down inside the feeding cassette 105 illustrated in FIG. 1 are fed out with the feed roller 101. Then, the sheets S, separated and fed out by the feed roller 101 that is working together with a separation member (not shown), is sent to the registration roller 102.

Meanwhile, together with the print command, a laser beam according to the image information is emitted from the laser scanner unit serving as the image exposing member (not shown). Then, the laser beam is irradiated on the surface of the photosensitive drum 106 that serves as the image carrier that is uniformly charged by the charge roller serving as a charge member (not shown) such that an electrostatic latent image is formed. The developer (toner) is supplied from the developing device serving as the development member (not shown) on the electrostatic latent image formed on the surface of the photosensitive drum 106 such that a toner image is formed.

The registration roller 102 conveys the sheet S to the transfer nip portion N between the photosensitive drum 106 and the transfer roller 103 that serves as a transfer means so that the sheet S corresponds to the position of the toner image that has been formed on the surface of the photosensitive drum 106. A transfer bias is applied to the transfer roller 103 such that the toner image formed on the surface of the photosensitive drum 106 is transferred to the sheet S. The sheet S on which the toner image has been transferred is sent to the fixing device 104 that serves as a fixing member is heated and compressed such that the toner image is fixed to the sheet S.

The sheet S to which the toner image has been fixed is nipped and conveyed by discharge rollers 202 and driven rollers 204 provided in the discharge portion 20 and is discharged onto the discharge tray 107. Furthermore, when images are formed on both surfaces of the sheet S, the sheet S that is nipped by the discharge rollers 202 and the driven rollers 204 is guided from the fixing device 104 to a both-surface path 108 by reverse rotation of the discharge rollers 202 at a predetermined timing such that the front and back sides are flipped. Subsequently, once again, the sheet S is nipped and conveyed by the registration roller 102 and is conveyed to the transfer nip portion N. Then, after the image forming operation is performed in a similar manner to that of the image forming operation performed on one side, the sheet S is discharged onto the discharge tray 107.

(Destaticizing Brush)

Figure 2:
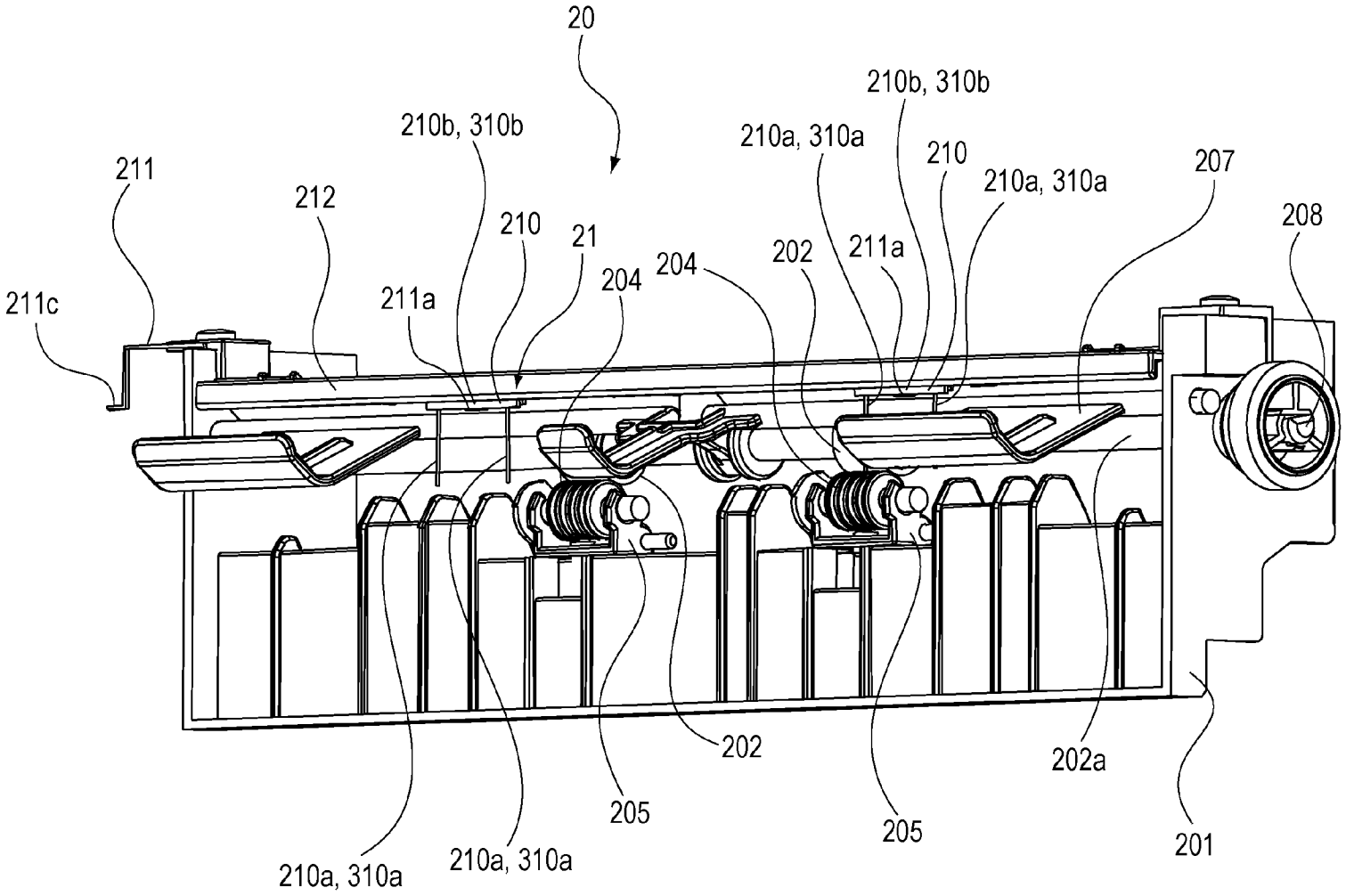
FIG. 2 is a perspective view for describing a configuration of a sheet discharge portion of the image forming apparatus including the destaticizing brush according to the first exemplary embodiment.

Referring next to FIGS. 1 to 6, a configuration of destaticizing brush units 210 serving as the destaticizing brushes of the present exemplary embodiment provided in the discharge portion 20 of the image forming apparatus 100 will be described. As illustrated in FIGS. 1 and 2, a destaticizing unit 21 in which the destaticizing brush units 210 serving as the destaticizing brushes are disposed in the two left and right portions in FIG. 2 in the vicinity and downstream of the discharge rollers 202 and the driven rollers 204 that are provided in the discharge portion 20 of the image forming apparatus 100 is provided.

As illustrated in FIGS. 1 and 2, when the sheet S nipped and conveyed by the discharge rollers 202 and the driven rollers 204 are discharged on the discharge tray 107, conductive brush members 210*a* provided in each of the destaticizing brush units 210 electrically comes in contact with and slides against the sheet S. At this time, the charged sheet S is discharged on the discharge tray 107 while being destaticized by the conductive brush members 210*a*.

As illustrated in FIG. 2, the discharge portion 20 in which the discharge rollers 202 and the driven rollers 204 are provided includes a discharge frame 201, the discharge rollers 202, and bearings (not shown) that rotatably and pivotally supports the discharge rollers 202. Furthermore, the discharge portion 20 includes driven rollers 204, holders 205 that rotatably support the driven rollers 204, and a pressurizing spring (not shown).

The discharge portion 20 further includes flags 207 that detect that the sheet S has been fully loaded on the discharge tray 107, and the destaticizing brush units 210 in which the conductive brush members 210*a* are provided. The discharge portion 20 further includes a conductive grounding member 211 that is in contact with the conductive brush members 210*a* in an electrical manner and that supports the destaticizing brush units 210, an attaching member 212 to attach the destaticizing brush units 210, and the like.

A rotational driving force is transmitted to a drive transmission gear 208 illustrated in FIG. 2 from a motor serving as a driving source (not shown). The drive transmission gear 208 is fixed to a drive shaft 202*a* of the discharge rollers 202. Furthermore, the discharge rollers 202 are rotationally driven by the rotational driving force transmitted to the discharge rollers 202 from the drive transmission gear 208 through the drive shaft 202*a*. The driven rollers 204 are in pressure contact with the discharge rollers 202 by a biasing force of the pressurizing spring (not shown) and is rotated by the rotation of the discharge rollers 202. The sheet S is nipped and conveyed by the discharge rollers 202 and the driven rollers 204 and is discharged on the discharge tray 107.

Figure 5:
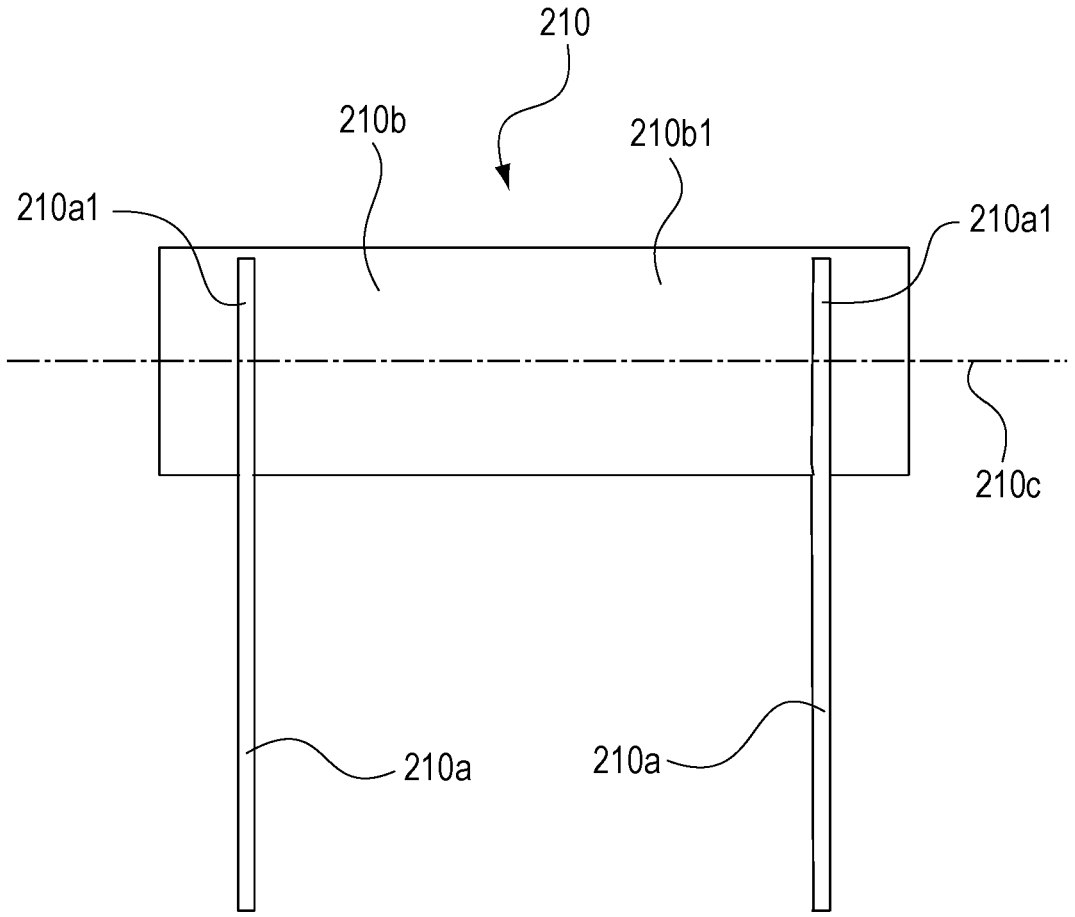
FIG. 5 is a front view for describing a configuration of the destaticizing brush of the first exemplary embodiment.

As illustrated in FIG. 5, the destaticizing brush units 210 are each configured so as to include the conductive brush members 210*a* and an adhesive tape member 210*b* serving as a tape member having adhesiveness. The adhesive tape member 210*b* of the present exemplary embodiment may not be conductive. End portions 210*a*1 of the conductive brush members 210*a* are adhered on an adhesive surface 210*b*1 serving as a surface of the adhesive tape member 210*b* having adhesiveness. Each of the conductive brush members 210*a* is formed of a thin line such as a metal or conductive resin fiber and is configured of a single piece of or a plurality of pieces of wire.

Figure 3A:
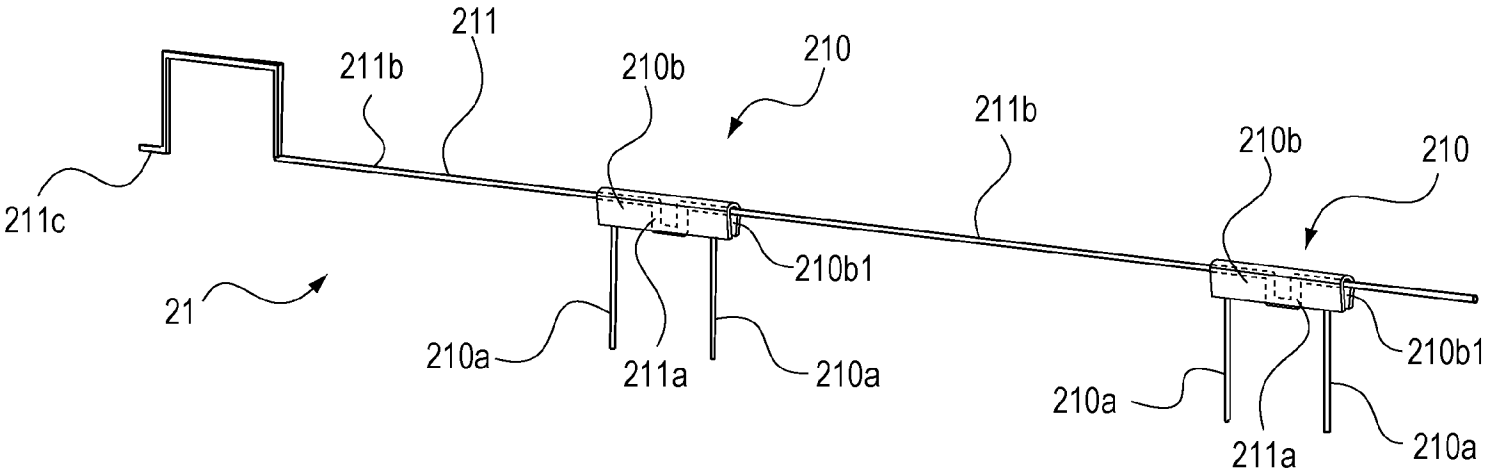
FIG. 3A is a perspective view for describing a configuration in which conductive brush members are provided in a grounding member in the destaticizing brush of the first exemplary embodiment.
Figure 3B:
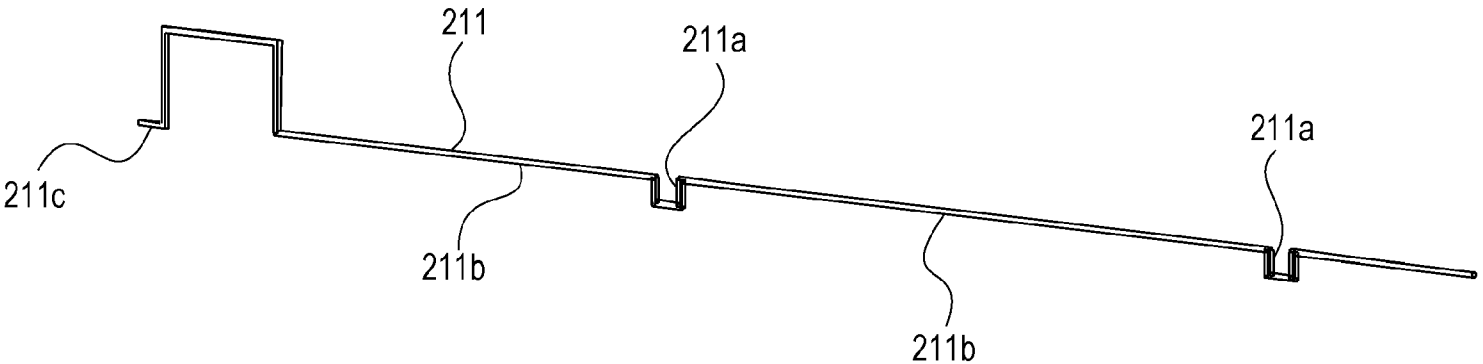
FIG. 3B is a perspective view for describing a configuration of the grounding member of the first exemplary embodiment.
Figure 4:
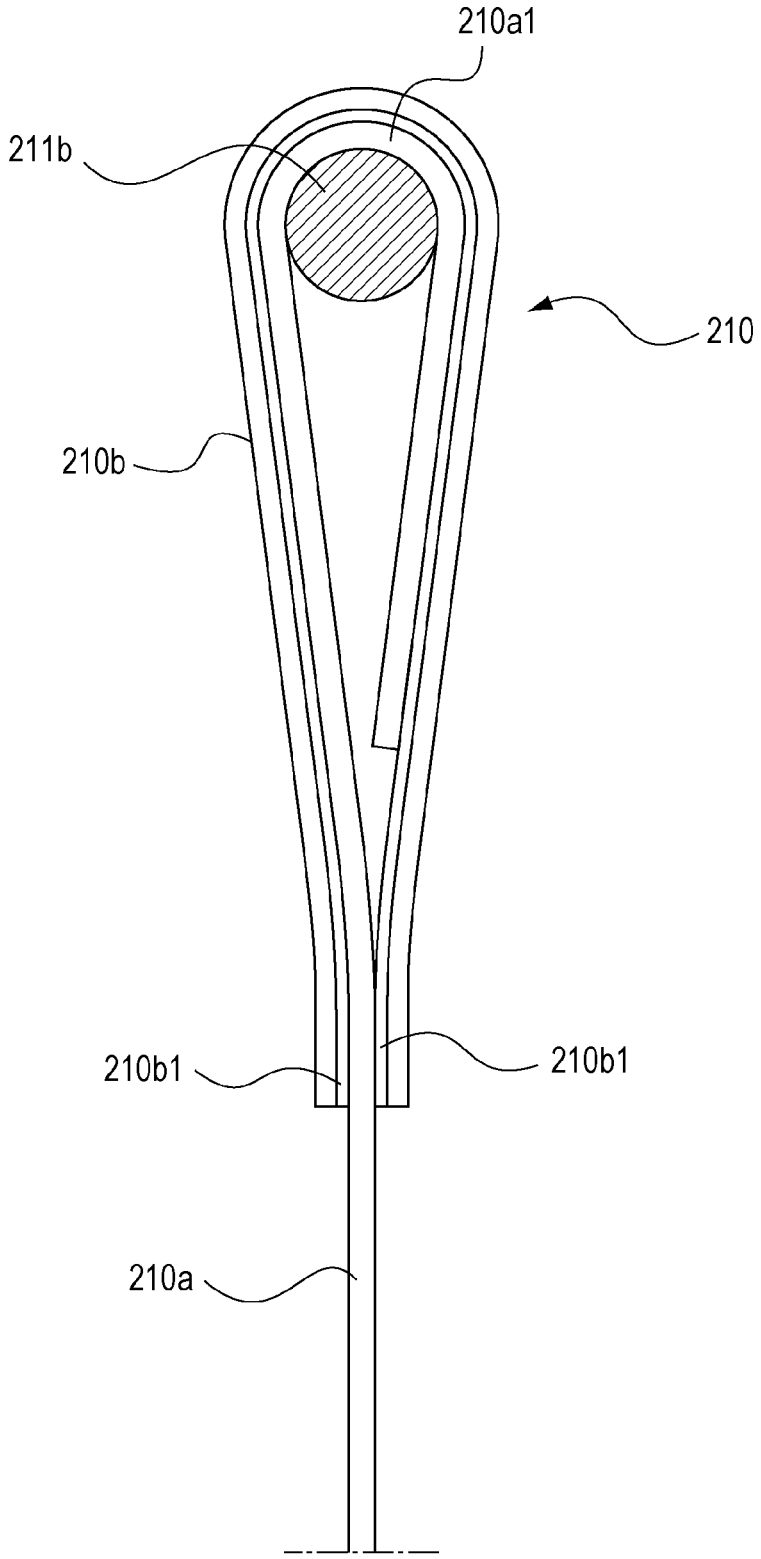
FIG. 4 is a cross-sectional view for describing a configuration of a contact portion between the conductive brush members and the grounding member of the destaticizing brush of the first exemplary embodiment.

The grounding member 211 illustrated in FIG. 3B is, as illustrated in FIG. 4, configured of a conductive wire spring (wire) having a circular section. U-shaped attaching portions 211*a* serving as bend portions formed by bending portions of the straight portion 211*b* in a U-shape are provided in the areas of the grounding member 211 where the destaticizing brush units 210 are attached.

In the destaticizing brush units 210 illustrated in FIG. 5, the adhesive tape member 210*b* is bent back in a U-shape at a return line 210*c* located at a substantially middle portion of the adhesive tape member 210*b* in a short direction (the up-down direction in FIG. 5) in an integrated manner with the end portions 210*a*1 of the conductive brush members 210*a* as illustrated in FIG. 3A. Then, as illustrated in FIGS. 3A and 3B, each of the attaching portions 211*a* of the grounding member 211 is disposed so as to be positioned at substantially the middle of the corresponding adhesive tape member 210*b* in a longitudinal direction (the left-right direction in FIG. 5).

Then, each of the destaticizing brush units 210 is fitted from the upper side towards the lower side in FIG. 3A across the straight portions 211*b* on both sides of the corresponding attaching portion 211*a*. In the conductive brush members 210*a*, the outer side portions of the end portions 210*a*1 that have been bent back in a U-turn shape is pressed using a jig (not shown) or the like so as to be attached while nipping the grounding member 211.

Then, the adhesive surface 210*b*1 of each adhesive tape member 210*b* is adhered to the surfaces of the corresponding straight portions 211 *b* and attaching portion 211*a* of the grounding member 211. Furthermore, areas other than the straight portions 211*b* and the attaching portions 211*a* of the grounding member 211 and the end portions 210*a*1 of the conductive brush members 210*a* are fixed by adhesion of the adhesive surfaces 210*b*1 of the adhesive tape members 210*b* to each other.

In the conductive brush members 210*a* of the present exemplary embodiment, the longitudinal direction (the up-down direction in FIGS. 3A and 5) of the conductive brush members 210*a* intersect the longitudinal direction (the left-right direction in FIGS. 3A and 3B) of the grounding member 211 illustrated in FIGS. 3A and 3B. The conductive brush members 210*a* are bent back in a U-turn shape along the outer peripheral surfaces of the straight portions 211*b* of the grounding member 211 in the above intersecting direction.

With the above, the end portions 210*a*1 of the conductive brush members 210*a* come in electric contact with the straight portions 211*b* of the grounding member 211. The outer peripheries of the bent back end portions 210*a*1 and the grounding member 211 are adhered to each other in an integrated manner with the adhesive tape members 210*b*.

Furthermore, as illustrated in FIGS. 3A and 4, one of the ends of each conductive brush member 210*a* is exposed from the corresponding adhesive tame member 210*b*. In the areas (the portions) of the adhesive tape member 210*b* other than the areas in contact with the straight portions 211*b* and the attaching portions 211*a* of the grounding member 211 and the conductive brush members 210*a*, the adhesive surfaces 210*b*1 (the surfaces that have adhesiveness) face each other and are adhered to each other.

As illustrated in FIG. 3A, rotation of the destaticizing brush units 210 about the straight portions 211*b* of the grounding member 211 is suppressed by having the adhesive tape member 210*b* be adhered to the attaching portions 211*a* serving as bend portions of the grounding member 211.

FIG. 4 is a cross-sectional explanatory drawing of the area of the straight portion 211*b* in a state in which the destaticizing brush unit 210 is attached across the straight portions 211*b* and the attaching portion 211*a* of the grounding member 211. As illustrated in FIG. 5, the end portions 210*a*1 of the two conductive brush members 210*a* provided in each destaticizing brush unit 210 are bent back in a U-turn shape as illustrated in FIG. 4 and are attached so as to be in electric contact with the straight portions 211*b* of the grounding member 211.

As illustrated in FIG. 4, in the straight portions 211*b* of the grounding member 211, the end portions 210*a*1 of the conductive brush members 210*a* to which the adhesive tape members 210*b* are adhered are bent back in a U-turn shape along the outer peripheral surfaces of the straight portions 211*b* of the grounding member 211. Furthermore, the end portions 210*a*1 of the conductive brush members 210*a* are folded back in a U-shape and the straight portions 211*b* of the grounding member 211 are nipped. Furthermore, while the end portions 210*a*1 of the conductive brush members 210*a* and the straight portions 211*b* of the grounding member 211 are in electric contact with each other, the outer peripherals of the end portions 210*a*1 of the conductive brush members 210*a* are adhered to the adhesive surfaces 210*b*1 of the adhesive tape members 210*b* facing inwards.

Meanwhile, in the attaching portions 211*a* serving as the bend portions that are formed by bending portions of the straight portions 211*b* of the grounding member 211 in a U-shape, the outer peripherals of the attaching portions 211*a* are adhered to the adhesive surfaces 210*b*1 of the adhesive tape member 210*b* facing inwards.

As illustrated in FIG. 4, other than the portions of the adhesive tape member 210*b*, which has been folded back in a U-shape, in the areas in contact with the conductive brush members 210*a* and the straight portions 211*b* and the attaching portions 211*a* of the grounding member 211, the adhesive surfaces 210*b*1 of the adhesive tape member 210*b* are adhered to each other. Accordingly, bonding strength is high.

The straight portions 211*b* of the grounding member 211 are directly in electric contact with the end portions 210*a*1 of the conductive brush members 210*a*. With the above, when one of the ends of the conductive brush members 210*a* that is exposed from the adhesive tape members 210*b* come in contact with the sheet S that is nipped and conveyed by the discharge rollers 202 and the driven rollers 204 illustrated in FIG. 2, then, the electric charge of the charged sheet S directly flows to the grounding member 211 through the conductive brush members 210*a*.

As illustrated in FIG. 2, the attaching portions 211*a* that are formed by bending portions of the straight portions 211*b* of the grounding member 211 of the present exemplary embodiment are provided in two portions. Furthermore, a destaticizing brush unit 210 is attached to each of the attaching portions 211*a*. Accordingly, even when each of the conductive brush members 210*a* come in contact to and slides against the sheet S that is nipped and conveyed by the discharge rollers 202 and the driven rollers 204, the conveyance balance between the left and right side of the sheet S illustrated in FIG. 2 can be kept.

Figure 6:
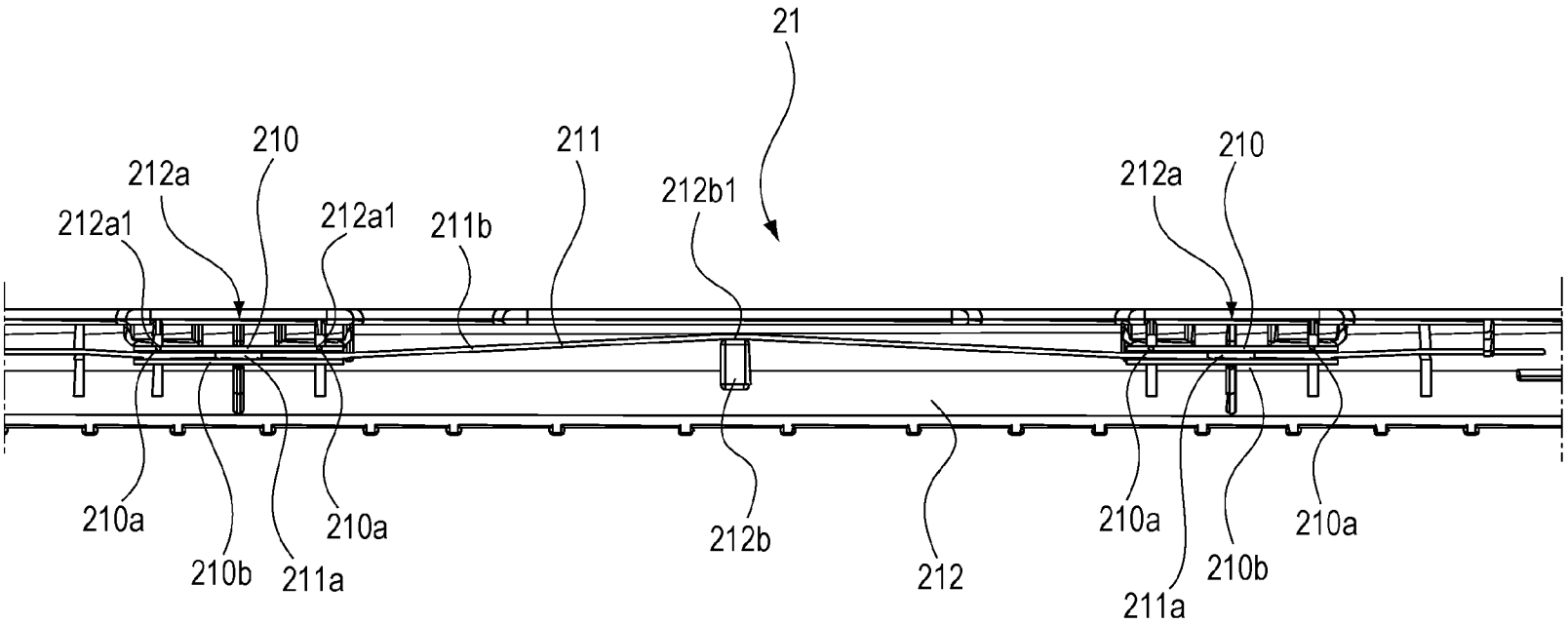
FIG. 6 is a bottom view of the destaticizing brush of the first exemplary embodiment attached to the attaching member viewed from the bottom side.

As illustrated in FIG. 3A, the destaticizing unit 21 in which the destaticizing brush units 210 and the grounding member 211 are provided in an integrated manner is attached to the attaching member 212 illustrated in FIG. 2. FIG. 6 is a bottom view of the destaticizing unit 21 attached to the attaching member 212 viewed from the bottom side. As illustrated in FIG. 3B, the straight portions 211*b* of the grounding member 211 looks like they are on a straight line when viewed from the front.

In the present exemplary embodiment, as illustrated in FIG. 6, the adhesive tape members 210*b* that have been folded back in a U-shape are fitted into and supported by holding portions 212*a* that are provided in the attaching member 212. Furthermore, the straight portions 211*b* of the grounding member 211 are abutted against and locked to an end face 212*b*1 of a rib pattern 212*b* provided at substantially a center portion of the left and right destaticizing brush units 210 of FIG. 6 such that the straight portions 211*b* of the grounding member 211 are bent towards that side of the paper surface and towards this side of the paper surface of FIG. 3B (in the up-down direction in FIG. 6). In the above state, the straight portions 211*b* of the grounding member 211 are attached to the attaching member 212 serving as a holding member holding the destaticizing unit 21 (destaticizing brushes).

Accordingly, as illustrated in FIG. 6, in the vicinity of the adhesive tape members 210*b* of the destaticizing brush units 210, the adhesive tape members 210*b* of the destaticizing brush units 210 are attached while being pressed against the holder surfaces (contact surfaces) 212*a*1 of the attaching member 212. The destaticizing unit 21 (the destaticizing brushes) are held by the attaching member (holding member) 212 while in a state in which the adhesive tape members 210*b* are pressed against the holder surfaces (contact surfaces) 212*a*1 of the attaching member (holding member) 212.

With the above, the electric contact between the conductive brush members 210*a* and the grounding member 211 becomes better even more. In other words, the rib pattern 212*b* functions as a member that presses the destaticizing brush unit 210 against the holder surfaces 212*a*1. Furthermore, with the attaching portions 211*a* that are formed by bending portions of the straight portions 211*b* of the grounding member 211 in a U-shape, rotation of the destaticizing brush units 210 about the straight portions 211*b* of the grounding member 211 can be suppressed. Accordingly, the angle and direction in which the conductive brush members 210*a* come in contact to and slide against the sheet S that is nipped and conveyed by the discharge rollers 202 and the driven rollers 204 illustrated in FIG. 2 become stable.

The grounding member 211 is grounded by being electrically connected to a conductive member that is electrically connected to a side plate that is grounded (not shown). In such a state, the conductive brush members 210*a* come in contact to and slides against the sheet S that is nipped and conveyed by the discharge rollers 202 and the driven rollers 204 illustrated in FIG. 2. With the above, the electric charge flows from the charged sheet S through each of the conductive brush members 210*a*, the grounding member 211 and, further, the conduction member and the side plate that are not shown; accordingly, the sheet S is destaticized.

In the present exemplary embodiment, the end portions 210*a*1 of the conductive brush members 210*a* that are bent back in a U-turn shape are directly in electric contact with the straight portions 211*b* of the grounding member 211. Furthermore, the straight portions 211*b* of the grounding member 211, the attaching portions 211*a*, and the end portions 210*a*1 of the conductive brush members 210*a* are adhered and fixed to each other in an integrated manner with the adhesive tape members 210*b*. With the above, a simple and inexpensive destaticizing brush can be provided.

The grounding member 211 can match the shape of an end portion 211*c* to the shape of each area of the image forming apparatus 100 in order to be electrically connected to an appropriate grounding place; accordingly, the grounding member 211 has excellent degree of freedom.

Second Exemplary Embodiment

Figure 7A:
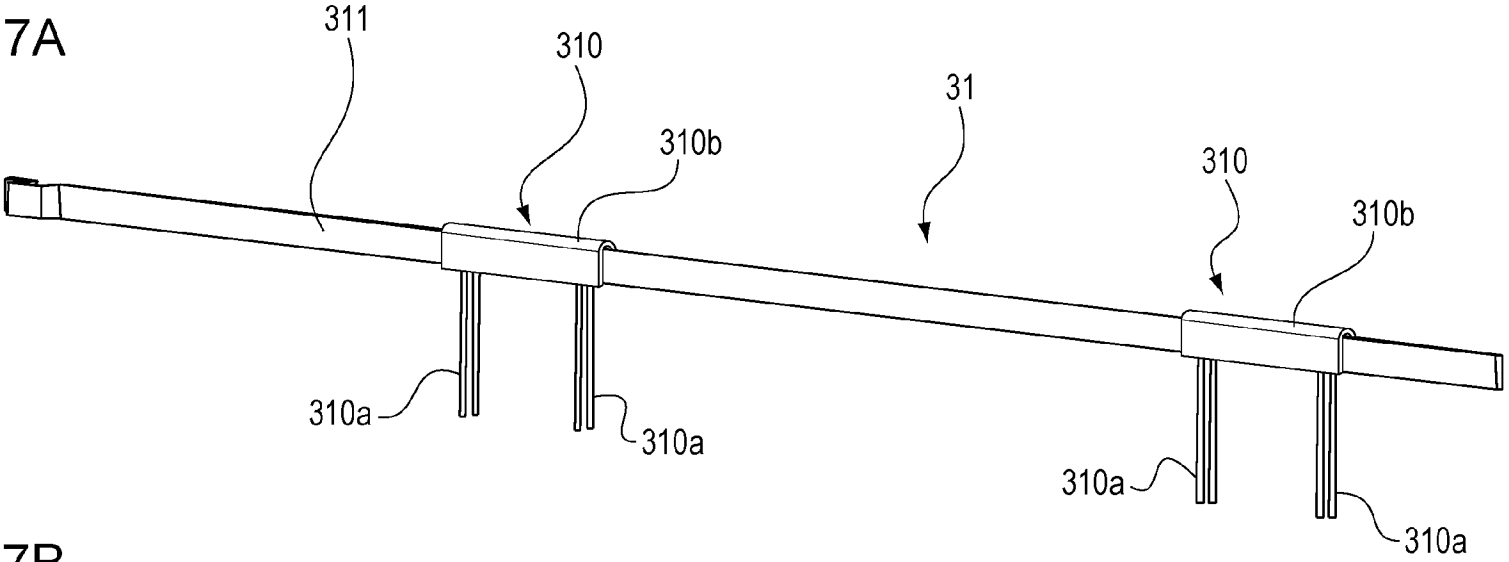
FIG. 7A is a perspective view for describing a configuration in which conductive brush members are provided in a grounding member in the destaticizing brush of the second exemplary embodiment.
Figure 7B:
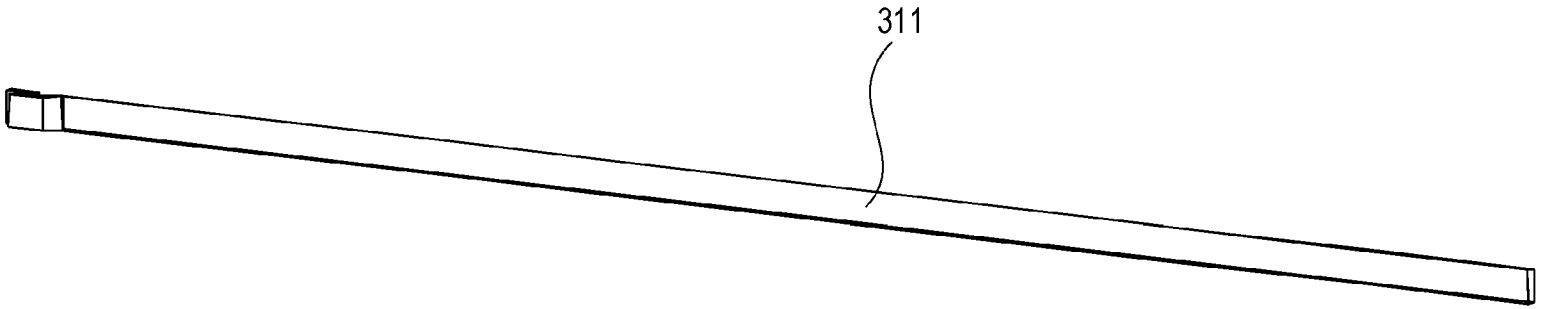
FIG. 7B is a perspective view for describing a configuration of the grounding member of the second exemplary embodiment.
Figure 8:
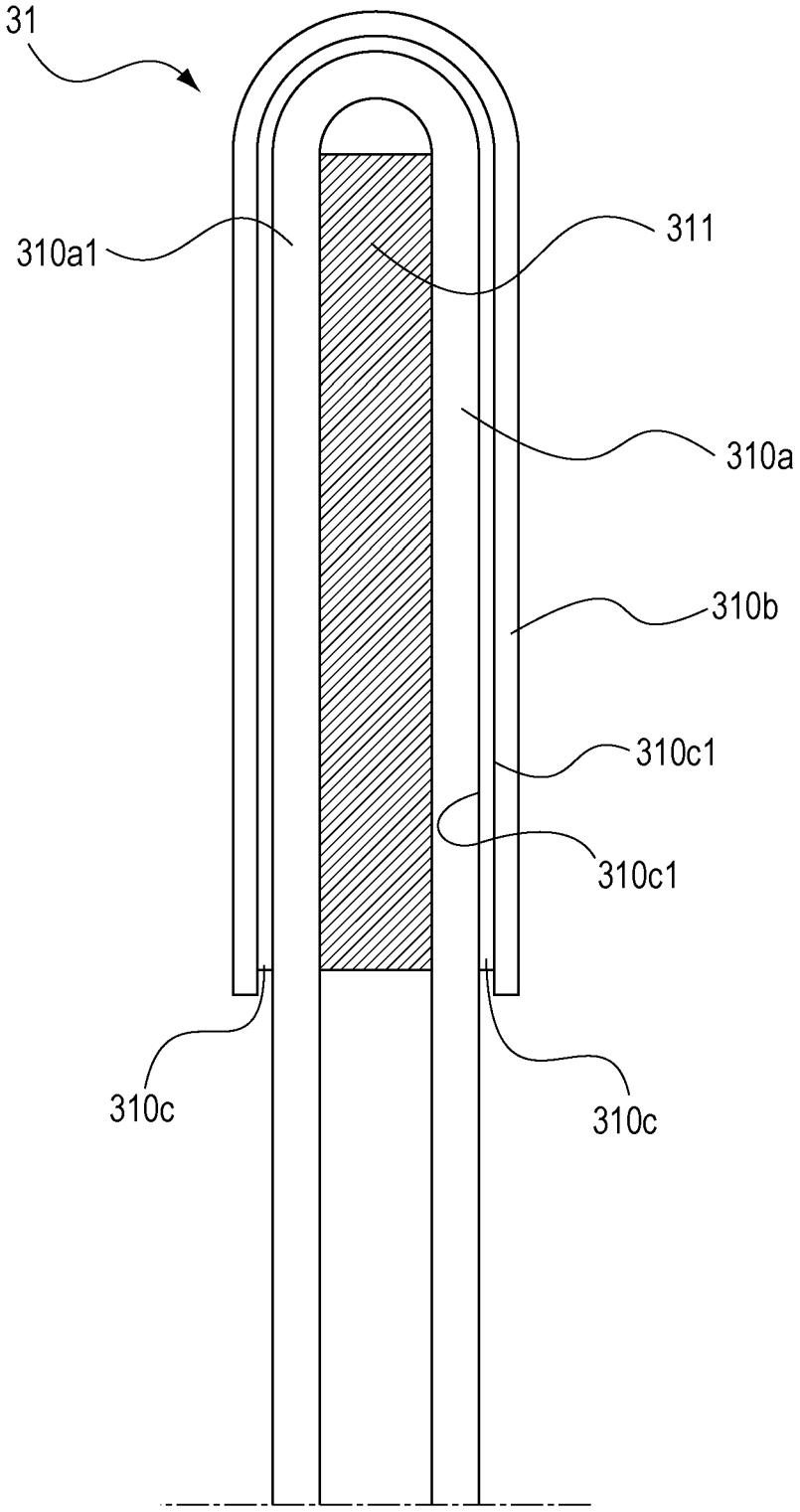
FIG. 8 is a cross-sectional view for describing a configuration of a contact portion between a conductive brush members and a grounding member of a destaticizing brush of the second exemplary embodiment.
Figure 9:
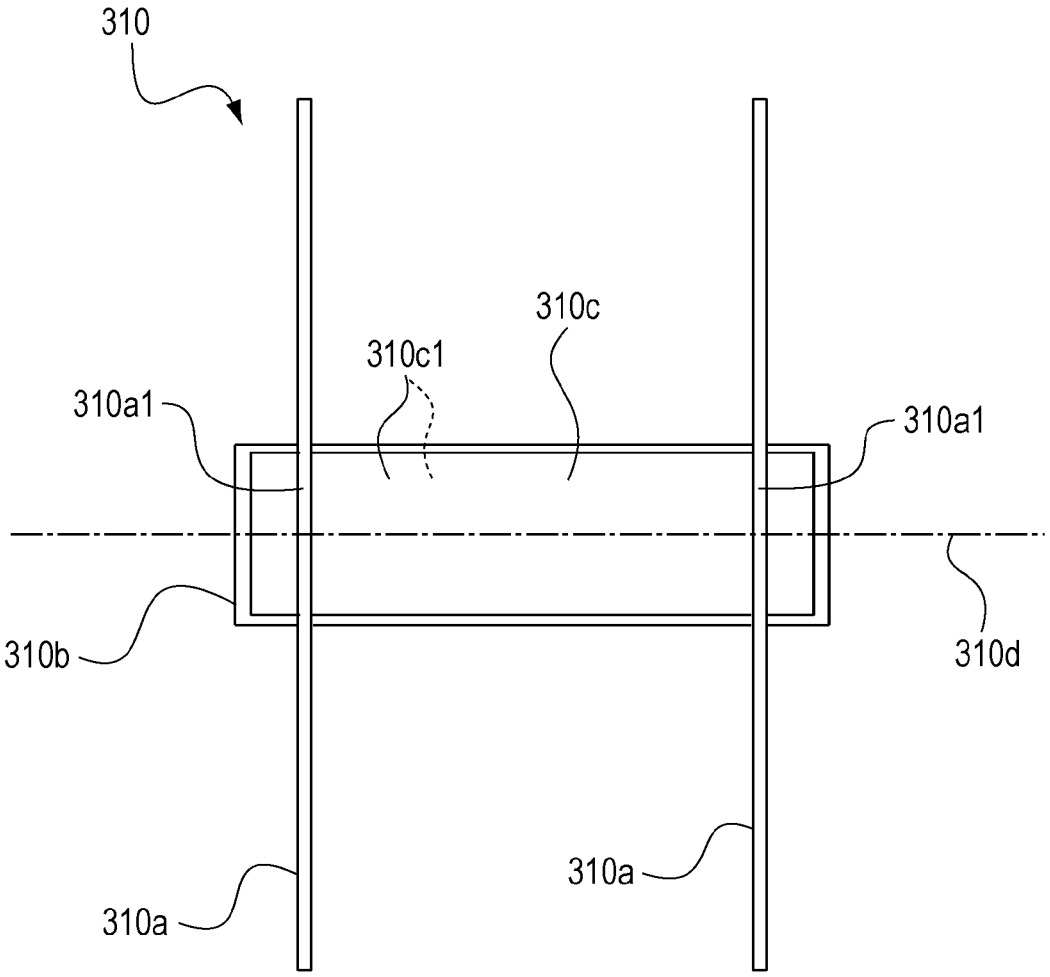
FIG. 9 is a front view for describing a configuration of the destaticizing brush of the second exemplary embodiment.

Referring to FIGS. 7 to 9, a configuration of a second exemplary embodiment of an image forming apparatus including a destaticizing brush according to the present disclosure will be described next. Note that description of members that are configured in a similar manner to the members of the first exemplary embodiment will be omitted and will be attached with the same reference numeral, and even if the reference numeral of the members are different, the same member name will be given.

As illustrated in FIG. 4, in the first exemplary embodiment, the grounding member 211 is configured of a wire spring that has a circular section, and as illustrated in FIG. 5, the adhesive tape members 210*b* are adhered to the end portions 210*a*1 of the conductive brush members 210*a*.

As illustrated in FIG. 8, in the present exemplary embodiment, a grounding member 311 is configured of a conductive metal plate that has a rectangular section. Furthermore, as illustrated in FIG. 9, sheet members 310*b* are adhered to center portions 310*a*1 of conductive brush members 310*a* through two-sided adhesive tape members 310*c* serving as tape members having adhesiveness. The adhesive two-sided adhesive tape members 310*c* and the sheet members 310*b* of the present exemplary embodiment may not be conductive.

As illustrated in FIG. 9, destaticizing brush units 310 serving as the destaticizing brushes of the present exemplary embodiment are each configured so as to include two conductive brush members 310*a*, the sheet member 310*b* and the adhesive two-sided adhesive tape member 310*c*. As illustrated in FIG. 7A, each destaticizing brush unit 310 is bent back in a U-shape at a return line 310*d* provided at substantially the center portions of the adhesive two-sided adhesive tape member 310*c* and the sheet member 310*b* illustrated in FIG. 9 in the short direction (the up-down direction in FIG. 9).

Furthermore, the destaticizing brush units 310 are fitted over the grounding member 311, which is formed of a conductive metal plate having a rectangular section, from the upper side to the lower side of FIG. 7A. In the conductive brush members 310*a*, the outer side portions of the center portions 310*a*1 that have been bent back in a U-turn shape is pressed using a jig (not shown) or the like so as to be attached while nipping the grounding member 311.

Then, the adhesive surfaces 310*c*1 of the adhesive two-sided adhesive tape members 310*c* are adhered and fixed to the surface of the grounding member 311. The two end portions of each of the conductive brush members 310*a* are exposed from the corresponding adhesive two-sided adhesive tape member 310*c* and the corresponding sheet member 310*b*.

The conductive brush members 310*a* of the present exemplary embodiment are bent in a U-turn shape along an outer peripheral surface of the ground member 311 and in the longitudinal direction, which is the up-down direction of FIG. 9, that intersects the longitudinal direction of the grounding member 311 indicated by the left-right direction of FIG. 7B. With the above, the center portions 310*a*1 of the conductive brush members 310*a* come in electric contact with the grounding member 311. The outer peripheries of the bent back center portions 310*a*1 and the grounding member 311 are adhered to each other in an integrated manner with the adhesive two-sided adhesive tape members 310*c*.

FIG. 8 is, as illustrated in FIG. 7A, a cross-sectional explanatory drawing of an area of the conductive brush member 310*a* in a state in which the destaticizing brush unit 310 is attached to the grounding member 311. The sheet member 310*b* and the adhesive two-sided adhesive tape member 310*c* are bent in a U-shape together with the center portion 310*a*1 of the conductive brush member 310*a* in an integrated manner and nip the grounding member 311 with the center portion 310*a*1 of the conductive brush member 310*a*. With the above, the center portions 310*a*1 of the conductive brush members 310*a* are in electric contact with the grounding member 311.

The grounding member 311 and the center portions 310*a*1 of the conductive brush members 310*a* are directly in electric contact with each other. With the above, similar to the first exemplary embodiment illustrated in FIG. 2, when the conductive brush members 310*a* come in contact with the sheet S that is nipped and conveyed by the discharge rollers 202 and the driven rollers 204, then, the electric charge of the charged sheet S directly flows to the grounding member 311 through the conductive brush members 310*a*.

As illustrated in FIG. 7A, the destaticizing brush units 310 are provided at two portions in the grounding member 311 of the present exemplary embodiment. Accordingly, similar to the first exemplary embodiment illustrated in FIG. 2, even when each of the conductive brush members 310*a* come in contact to and slides against the sheet S that is nipped and conveyed by the discharge rollers 202 and the driven rollers 204, the conveyance balance between the left and right side of the conveyed sheet S illustrated in FIG. 2 can be kept.

As illustrated in FIG. 7A, the destaticizing unit 31 in which the destaticizing brush units 310 and the grounding member 311 are provided in an integrated manner is, in a substantially similar manner to the first exemplary embodiment illustrated in FIG. 2, attached to the attaching member 212. As illustrated in FIG. 8, since sheet members 310*b* that do not have adhesiveness is adhered on outside adhesive surfaces 310*c*1 of the adhesive two-sided adhesive tape members 310*c*, there is no hindrance when attaching the destaticizing brush units 310 to the attaching member 212.

The grounding member 311 is grounded by being electrically connected to a conductive member that is electrically connected to a side plate that is grounded (not shown). In such a state, the conductive brush members 310*a* come in contact to and slides against the sheet S that is nipped and conveyed by the discharge rollers 202 and the driven rollers 204 illustrated in FIG. 2. With the above, the electric charge flows from the charged sheet S through each of the conductive brush members 310*a*, the grounding member 311 and, further, the conduction member and the side plate that are not shown; accordingly, the sheet S is destaticized. With the above, a simple and inexpensive destaticizing brush can be provided.

In place of the adhesive tape member 210*b* of the first exemplary embodiment, as is the case of the present exemplary embodiment, a tape member with weak adhesiveness, a sheet member 310*b* with no adhesiveness, and an adhesive material such as an adhesive two-sided adhesive tape member 310*c* may be used to obtain a similar effect as that of the first exemplary embodiment.

Furthermore, in the present exemplary embodiment, destaticizing is performed by the two end portions of each conductive brush member 310*a* coming in contact and shifting against the sheet S that is nipped and conveyed by discharge rollers 202 and the driven rollers 204. With the above, the destaticizing effect can be increased with fewer conductive brush members 310*a*. Other configurations are configured in the same manner as those of the first exemplary embodiment and a similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-247890, filed Dec. 8, 2014, which is hereby incorporated by reference herein in its entirety.

What is claimed is:

1. A destaticizing brush, comprising:

a grounding member that performs electrical grounding and is a singular continuous element that includes a straight portion and a bent portion, the straight portion having a shape extending from a first end of the grounding member toward a second end of the grounding member, the bent portion being formed between the first end and the second end and by being bent with respect to the straight portion;

a conductive brush member configured of at least two pieces of wire that come in contact with an object; and a tape member that has adhesiveness, wherein the conductive brush member is bent back in a U-shape around an outer periphery of the grounding member and comes in contact with the grounding member, the tape member adheres to the conductive brush member and a part of the grounding member in an integrated manner while the tape member covers an outer periphery of the conductive brush member bent in the U-shape, the part of the grounding member including the straight portion and the bent portion, and at least one end of the conductive brush member is exposed from the tape member and comes in contact with the object.

2. The destaticizing brush according to claim 1, wherein the tape member includes an adhesive layer and a portion of the adhesive layer adheres to another portion of the adhesive layer to face each other.

3. The destaticizing brush according to claim 2, wherein the at least one end of the conductive brush member and another end of the conductive brush member are exposed from the tape member.

4. The destaticizing brush according to claim 1, wherein the grounding member is a conductive wire spring that has a circular section.

5. The destaticizing brush according to claim 4, wherein the bent portion has a shape projecting in a direction intersecting a direction in which the straight portion extends.

6. The destaticizing brush according to claim 5, wherein the tape member is a single piece of two-sided adhesive tape that adheres to the bent portion and the conductive brush member to each other.

7. The destaticizing brush according to claim 1, wherein the tape member is a two-sided adhesive tape having no conductivity.

8. The destaticizing brush according to claim 1, wherein at least two pieces of wire are disposed on either side of the bent portion of the grounding member.

9. An image forming apparatus, comprising:

an image forming device that forms an image on a sheet; and a destaticizing brush that comes in contact with a sheet that is conveyed and that destaticizes the sheet, the destaticizing brush comprising:

a grounding member that performs electrical grounding and is a singular continuous element that includes a straight portion and a bent portion, the straight portion having a shape extending from a first end of the grounding member toward a second end of the grounding member, the bent portion being formed between the first end and the second end and by being bent with respect to the straight portion;

a conductive brush member configured at least two pieces of wire that come in contact with the sheet;

and a tape member that has adhesiveness, wherein the conductive brush member is bent back in a U-shape around an outer periphery of the grounding member and comes in contact with the grounding member, the tape member adheres to the conductive brush member and a part of the grounding member in an integrated manner while the tape member covers an outer periphery of the conductive brush member bent in the U-shape, the part of the grounding member including the straight portion and the bent portion, and at least one end of the conductive brush member is exposed from the tape member and comes in contact with the sheet.

10. The image forming apparatus according to claim 9, wherein the tape member includes an adhesive layer, and a portion of the adhesive layer adheres another portion of the adhesive layer to face each other.

11. The image forming apparatus according to claim 10, wherein the one end of the conductive brush member and another end of the conductive brush member are exposed from the tape member.

12. The image forming apparatus according to claim 9, wherein the grounding member is a conductive wire spring that has a circular section.

13. The image forming apparatus according to claim 12, wherein the bent portion has a shape projecting in a direction intersecting a direction in which the straight portion extends.

14. The image forming apparatus according to claim 13, wherein the tape member is a single piece of two-sided adhesive tape that adheres to the bent portion and the conductive brush member to each other.

15. The image forming apparatus according to claim 9, wherein the tape member is a two-sided adhesive tape having no conductivity.

16. The image forming apparatus according to claim 9, wherein at least two pieces of wire are disposed on either side of the bent portion of the grounding member.

* * * * *